US012078414B2

(12) United States Patent
Olivo Danse et al.

(10) Patent No.: US 12,078,414 B2
(45) Date of Patent: Sep. 3, 2024

(54) PRODUCT TRANSPORT CONTAINER WITH A DESIRED TEMPERATURE RANGE

(71) Applicants: Olivo, Roche-la-Molière (FR); Messer SE & Co KGaA, Bad Soden/Taunus (DE)

(72) Inventors: Hélène Françoise Olivo Danse, Roche-la-Molière (FR); Jean-Claude Claeys, Puurs (BE); Emir Tebib, Le Plessis Belleville (FR); Johanna Schrimacher Mroch, Willich (DE)

(73) Assignees: Olivo, Roche-la-Molière (FR); Messer SE & Co KGaA, Bad Soden/Taunus (DE)

( * ) Notice: Subject to any disclaimer, the term of this patent is extended or adjusted under 35 U.S.C. 154(b) by 299 days.

(21) Appl. No.: 17/598,328

(22) PCT Filed: Mar. 26, 2019

(86) PCT No.: PCT/FR2019/050692

§ 371 (c)(1),
(2) Date: Sep. 27, 2021

(87) PCT Pub. No.: WO2020/193872

PCT Pub. Date: Oct. 1, 2020

(65) Prior Publication Data

US 2022/0178605 A1 Jun. 9, 2022

(51) Int. Cl.
*F25D 3/14* (2006.01)

(52) U.S. Cl.
CPC ..... *F25D 3/14* (2013.01); *F25D 2303/0844* (2013.01); *F25D 2331/804* (2013.01)

(58) Field of Classification Search
CPC .... F25D 3/14; F25D 2303/0844; F25D 3/125; F25D 2331/80453; F25D 2331/468;
(Continued)

(56) References Cited

U.S. PATENT DOCUMENTS

2017/0284723 A1* 10/2017 Newman ..... A23L 3/364

* cited by examiner

*Primary Examiner* — Cassey D Bauer

(57) ABSTRACT

The present invention relates to the transport of products in a desired conservation temperature range, comprising:

a box (2) made of insulating material delimiting a compartment opened upwards having a volume less than 150 liters and able to contain products, the box (2) having a determined heat dissipation value;

a cover (4) made of insulating material adaptable on the box (2) to seal the compartment;

a diffusing divider wall (5) interposed between the box (2) and the cover (4) to delimit with the cover (4), a chamber with a surface (7) for receiving at least one refrigerated load (6) emitting a heat value, the cover (4) and the divider wall (5) comprising complementary means for locking/unlocking (9) with one another;

characterized in that the heat energy emitted by the refrigerated load (6) and the thermal diffusion coefficient of the divider wall (5) are adjusted such that, at determined transport and conservation temperatures and for a desired duration after receiving the refrigerated load (6) and exposure of the container (1) to the transport temperature, the heat value diffused by the divider wall (5) to the compartment is equal to, or at most 20% greater than the heat value dissipated by the box (2).

5 Claims, 8 Drawing Sheets

(58) Field of Classification Search
CPC ..... B65B 43/41; B65B 43/38; B65B 43/54;
B65B 5/04; B65B 7/26; B65B 63/00;
A23L 3/364
See application file for complete search history.

PRODUCT TRANSPORT CONTAINER WITH A DESIRED TEMPERATURE RANGE

RELATED APPLICATION

This application is a National Phase of PCT Patent Application No. PCT/FR2019/050692 having International filing date of Mar. 26, 2019, the contents of which are incorporated herein by reference in their entirety.

FIELD AND BACKGROUND OF THE INVENTION

The present invention relates to the technical field of keeping products contained in isothermal containers at a positive or negative temperature. The invention more specifically relates to a transport container having a volume less than 150 L.

By products, this means, for example, perishable foods, and more broadly, of which the nature, the composition, the origin or the destination impose strict and controlled storage and/or warehousing conditions involving them being kept at a reduced temperature, so as to guarantee their integrity in view of a later use or also a suitable consumption.

The type of container of the present invention has an advantageous application in the case of mail order selling, involving long transport, i.e. up to 15 hours, for example.

The invention also relates to a method and an installation for loading a refrigerated load in this type of container.

In the field of product transport containers, document FR 2 802 186 is known, which describes a container comprising:

- a box made of insulating material delimiting a compartment opened upwards having a volume less than 150 L and able to contain the products;
- a cover made of insulating material, adaptable on the box to seal the compartment;
- a diffusing divider wall interposed between the box and the cover to delimit with the cover, a chamber with a surface for receiving at least one refrigerated load, the cover and the divider wall comprising complementary means for locking/unlocking with/from one another.

In theory, this type of container ensures, from the initial product packaging step, until the final use or consumption step, as well as for the whole duration of packaging and transport elapsing between these two steps, that the storage temperature is maintained.

However, the duration of maintaining the temperature of this type of container is, in practice, not well controlled. Moreover, the refrigerated load put in place between the cover and the divider wall is often oversized, which leads to waste and an increase in cost price of the container.

Finally, this type of container is well-adapted to maintaining products at temperature comprised between −40° C. and −18° C. However, when food must be maintained at a narrower temperature, in particular between 0° C. and 4° C., the operation becomes more difficult, even impossible.

SUMMARY OF THE INVENTION

One of the aims of the invention and therefore to overcome the disadvantages of the prior art by proposing a product transport container at a desired conservation temperature which allows to totally control the temperature inside the container, whether this is at a temperature range going from −40° C. to −18° C. or at a temperature range going from 0° C. to 4° C., for example.

Another aim of the invention is to provide such a container, of which the necessary quantity of refrigerated load is also controlled, by avoiding any waste.

To this end, a product transport container has been developed at a desired conservation temperature range, according to that of the state of the art in that it comprises:

- a box made of insulating material delimiting a compartment opened upwards having a volume less than 150 L and able to contain the products;
- a cover made of insulating material, adaptable on the box to seal the compartment;
- a diffusing divider wall interposed between the box and the cover to delimit with the cover, a chamber with a surface for receiving at least one refrigerated load, the cover and the divider wall comprising complementary means for locking/unlocking with/from one another.

By considering the fact that the box has a determined heat dissipation value, and that the refrigerated load is adapted to emit a determined heat energy, the invention consists in that the heat energy emitted by the refrigerated load and the thermal diffusion coefficient of the divider wall are adjusted such that, at determined transport and conservation temperatures and for a desired duration after receiving the refrigerated load and exposure of the container to the transport temperature, the heat value diffused by the divider wall to the compartment is equal to, or at most 20% greater, to the heat value dissipated by the box outwards.

In this way, the invention allows to provide a transport container adapted for home delivery over relatively long durations, of about ten hours, by perfectly controlling the temperature inside the container. Indeed, the container is designed to consider, in particular, the transport temperature, but also the conservation temperature, the desired transport duration, the heat value dissipated by the box, the heat energy emitted by the refrigerated load, and the thermal diffusion coefficient of the divider wall.

This also results that the quantity of heat load is perfectly adapted to the actual needs.

The advantage of the present invention is also to provide a container having a so-called standard box, on which only the cover, the divider wall, and the refrigerated load are adapted to the desired application. In an even more advantageous manner, the cover is also standard.

To make the thermal diffusion coefficient of the divider wall vary, it is possible to make a plurality of parameters vary, such as the receiving surface of the refrigerated load, the thickness of the divider wall, its material and its density, etc.

The heat energy emitted by the refrigerated load is, itself, adjusted, for a determined divider wall, according to the nature of the refrigerated load and its quantity.

According to a particular embodiment, the divider wall is perforated so as to constitute a means for complementarily adjusting the thermal diffusion coefficient. Indeed, in practice, the thickness of the divider wall can be subjected to rigidity and thickness constraints, such that it can be advantageous to not decrease the thickness, but to perforate it to better adjust its thermal diffusion coefficient.

Advantageously, the according to another characteristic taken individually from the characteristics at the basis of the invention, or in combination with the preceding characteristics, the cover and the divider wall are independent from one another, and comprise complementary articulation means able to allow the pivoting of the cover, preferably by an angle comprised between 10° and 60° with respect to the divider wall and along a pivoting edge, to enable the putting into place of the refrigerated load inside the chamber, without disconnecting the cover and the divider wall.

In other words, it could absolutely be considered to provide a container and the divider wall are independent from one another and comprise complementary articulation means able to allow the pivoting of the cover with respect to the divider wall and along a pivoting edge, to enable the putting into place of the refrigerated load inside the chamber, without implementing the adjustment of the heat energy emitted by the refrigerated load and of the thermal diffusion coefficient of the divider wall.

According to a particular embodiment, the means for articulating the cover comprise at least one groove arranged along the pivoting edge of the cover and facing the divider wall. A projecting ridge with a circular cross-section borders the inner side of the groove, i.e. the side opposite the pivoting edge, and the complementary articulation means of the divider wall comprise at least one groove complementary to the projecting ridge intended to engagingly receive said ridge with pivoting capacity.

According to a particular embodiment, the locking/unlocking means of the cover comprise two side strips, each projecting orthogonally from a side edge of the cover and in the direction of the divider wall. Each strip has, at its free end, a lug projecting in the direction of the opposite strip, and the locking/unlocking means of the divider wall comprise side edges projecting towards the cover and wherein are arranged notches complementary to the side strips and to the lugs.

In a particular embodiment, and with the aim of decreasing the consumption of the refrigerated load, and according to the transport temperature of the container, such as for example in a temperature-controlled lorry, or in an ambient-temperature lorry, the receiving surface of the divider wall is split into two receiving zones by a central strip perpendicular to the pivoting edge, in view of adapting the quantity of refrigerated load to the desired application, for example by positioning a refrigerated load in one of the zones.

According to a particular embodiment, the locking/unlocking means comprise, individually or in combination with the means described above, two front strips projecting orthogonally from the edge of the cover opposite the pivoting edge, and in the direction of the divider wall. The two strips are positioned on either side of the central strip and together delimit a form of restraint, the end of the central strip facing the form of restraint comprises a complementary form of restraint to be locked between the two front strips.

In a preferred embodiment, the cover and the divider wall are molded in one same material.

Preferably, the refrigerated load is constituted by a carbon dioxide mass in the form of snow or ice.

The invention also relates to a method for loading a container with refrigerated load, such as described above.

According to the invention, and from a divider wall on which is placed the cover with the capacity to pivot with respect to the divider wall and along a pivoting edge, the method comprises steps consisting of:

- making the cover automatically pivot with respect to the divider wall, preferably by an angle comprised between 10° and 60°, to free up an access to the chamber for receiving the refrigerated load;
- automatically pushing at least one refrigerated load inside the chamber.

The method is therefore simple and rapid to implement. The refrigerated load is automatically pushed, without additional handling, without loss, and without contact with the operator.

Advantageously, the method comprises an additional step consisting of automatically engaging the complementary locking means of the cover and of the divider wall to seal the refrigerated load inside the chamber. Optionally, this operation can be carried out manually by an operator.

Advantageously, the method comprises an additional step consisting of automatically controlling the loading of the refrigerated load, and:

- in case of non-loading or partial loading, the cover and the divider wall are sent to a reject or correction station;
- in case of valid loading, the cover and the divider wall are sent to a closing station.

The invention also relates to an installation for the implementation of the method comprising:

- means for supporting a divider wall on which a cover is placed;
- automatic pivoting means of the cover;
- means for supplying a refrigerated load and for pushing the refrigerated load inside the chamber.

DESCRIPTION OF SPECIFIC EMBODIMENTS OF THE INVENTION

In reference to FIGS. 1 to 11, the invention relates to a container (1) intended to transport products at a desired conservation temperature, for example at a temperature comprised between −40° C. and −18° C. for the storage of frozen products, or at a temperature comprised between 0° C. and 4° C. for the storage of fresh products.

The container (1) comprises a box (2) made of insulating material delimiting a compartment opened upwards and of a volume less than 150 L.

The compartment is adapted to contain the products to be maintained at temperature. The box (2) advantageously and internally comprises conformations such as ridges (3) intended to favor the circulation of energy to establish a constant temperature gradient as low as possible spread into all points of the compartment.

The container (1) also comprises a cover (4) made of insulating material which can be mounted on the box (2) to close the compartment.

Figure 1:
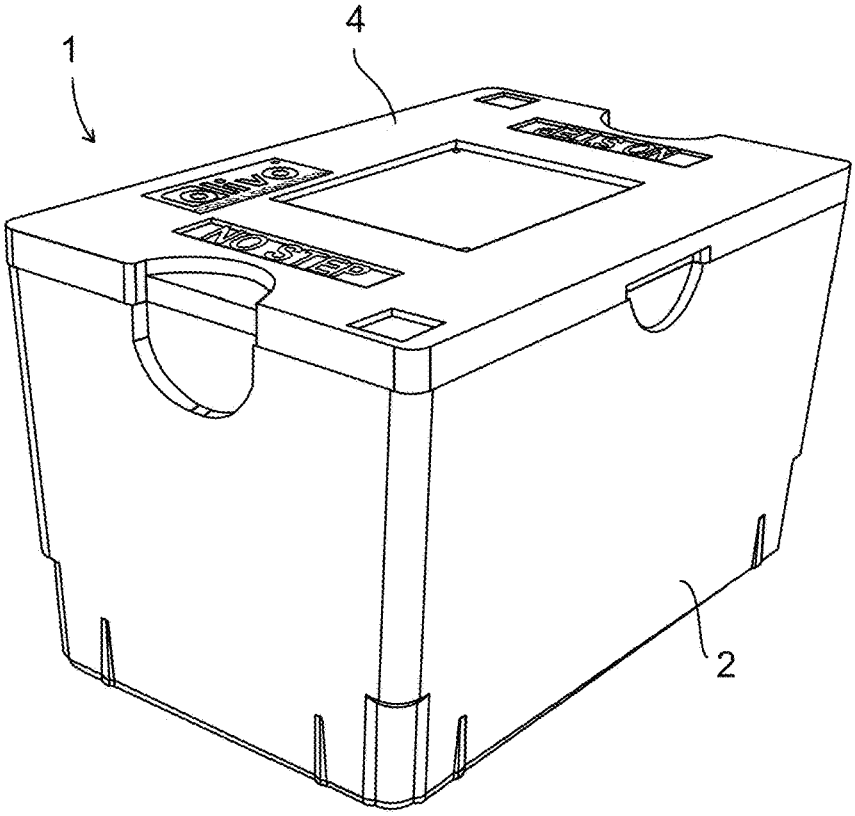
FIG. 1 is a perspective view of the transport container according to the invention.
Figure 2:
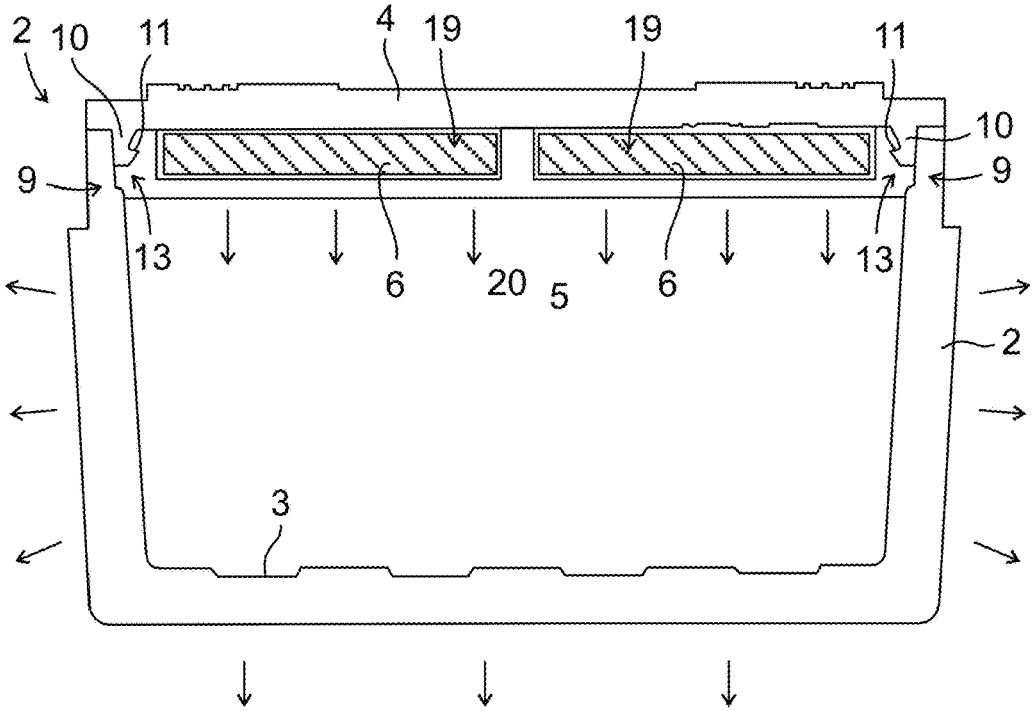
FIG. 2 is a longitudinal and vertical cross-sectional view of the container according to the invention.

In reference to FIG. 2, the container (1) comprises a diffusing divider wall (5) interposed between the box (2) and the cover (4) to delimit with the cover (4), a chamber with a surface (7) for receiving at least one refrigerated load (6) emitting a heat value.

The box (2), the cover (4) and the divider wall (5) are constituted of a material having good thermal insulation characteristics, associated with a low density. For example, this material can be polystyrene, expanded or extruded, or expanded polyethylene, or expanded polypropylene offering the additional advantage of allowing the different portions of the container (1) to be made by molding.

The container (1) has a general rectangular parallelepiped shape, but this shape must not be considered as limiting the scope of the invention.

From the above, the box (2) has a determined heat dissipation value, and the divider wall (5) has a specific thermal diffusion coefficient.

According to the invention, the heat energy emitted by the refrigerated load (6) and the heat diffusion coefficient of the divider wall (5) are adjusted such that, at determined transport and conservation temperatures and for a desired duration after receiving the refrigerated load (6) and exposure of the container (1) to the transport temperature, the heat value diffused by the divider wall (5) to the compartment is equal to, or at most 20% greater than the heat value dissipated by the box (2) outwards.

FIG. 2 illustrates the heat value diffused by the divider wall (5) to the compartment, and the heat value dissipated by the box (2) outwards.

Indeed, the transport container (1), according to the invention, is intended, for example, for mail order selling, and in particular for home delivery. To this end, after having placed a refrigerated load (6) in the chamber delimited between the cover (4) and the divider wall (5), the cover (4) and the divider wall (5) are locked onto one another and positioned on the box (2) to close the compartment which have previously received the products to be maintained at temperature.

At this stage, the transport container (1) is shipped and transported under particular conditions, i.e. for a certain time, and by being exposed to a transport temperature, which can be an ambient temperature or a specific temperature of a temperature-controlled lorry, for example.

According to the invention, the heat energy emitted by the refrigerated load (6) and the thermal diffusion coefficient of the divider wall (5) are adjusted to allow the diffusion of a heat value inside the compartment, corresponding substantially to actual needs, to avoid any waste of refrigerated load (6).

To do this, the thermal diffusion coefficient of the divider wall (5) can be adjusted in any suitable manner, for example, by adjusting the surface (7) for receiving the refrigerated load (6), or by modifying the nature of the material constituting the divider wall (5), its thickness, or by making a plurality of perforations (8), etc.

The heat value of the refrigerated load (6) is adjusted according to the quantity and to the nature of the refrigerated load (6), which can be, for example, in the form sticks, granules, carbon dioxide blocks, negative temperature eutectic plates, etc. Preferably, the refrigerated load (6) is constituted of a carbon dioxide mass, in the form of dry snow or dry ice.

As an example, below, different refrigerated loads and their heat energy per kilogram are mentioned:

dry ice: 627 KJ/Kg

Eutectic −3° C.: 325 KJ/Kg

Eutectic −21° C.: 274 KJ/Kg

Water (regular ice): 334 KJ/Kg

In practice, the heat value diffused through the divider wall (5) to the compartment can be expressed as follows:

$$Prdif = \frac{Sr \times |(Trf - Tmaint)|}{\sum \frac{er}{\lambda r}}$$

With:

Sr: the exchange surface (7);

λr: the thermal conductivity of the material of the divider wall (5);

er: the thickness of the divider wall (5);

Trf: the phase change temperature of the refrigerated load (6);

Tmaint: the conservation temperature to be obtained in the box (2).

The heat value dissipated by the box (2) can be expressed as follows:

$$Pbdiss = \sum \frac{eb}{\lambda b} \times smb \times |(Tamb - Tmaint)|$$

With:

Smb: the geometric surface (7) of the box (2);

λb: the thermal conductivity of the material of the box (2);

eb: the thickness of the wall of the box;

Tamb: the transport temperature;

Tmaint: the conservation temperature to be obtained in the box (2).

The heat value dissipated by the box (2) considers the geometry of the box, its value depending on its exchange surface between the outside and the inside.

The conductivity of a material is its capacity to conduct heat linearly. The heat value dissipated by the box (2) is qualified with the thermal diffusion coefficient value K in $W/m^2$. ° C. The greater this value is, the more diffusion there will be, the less efficient it is in insulating capacity.

As examples:

- a box (2) having a thickness of 95 mm (9 mm of polyethylene+86 mm of polyurethane) has a value of K=0.31 $W/m^2$. ° C.
- a box (2) having a thickness of 35 mm of expanded polypropylene has a value of K=0.87 $W/m^2$. ° C.

The conductivity of materials (λ) is measured in $W/m^2$. ° C. The insulating materials have conductivities comprised between 0.020 and 0.060 $W/m^2$. ° C.

EXAMPLES

Polyurethane: 0.021 $W/m^2$. ° C.

Expanded polypropylene: 0.038 $W/m^2$. ° C.

Glass wool: between 0.030 and 0.040 $W/m^2$. ° C.

Expanded polystyrene: 0.036 $W/m^2$. ° C.

According to the invention, the heat energy emitted by the refrigerated load (6) and the thermal diffusion coefficient of the divider wall (5) are adjusted to obtain:

$$Pbdiss \geq Prdif \leq 1.2 \times Pbdiss$$

The container (1) according to the invention can also, either for storing frozen products at a temperature comprised between −40° C. and −18° C., or fresh products at a temperature comprised between 0° C. and 4° C.

Example 1

As an example, for the transport of frozen products at a conservation temperature of −20° C.:

The box (2) is made of expanded polypropylene, delimiting a compartment having an inner surface area of 0.10 $m^2$. The walls of the box (2) have an average thickness of 35 mm.

The heat value dissipated by the example of an expanded polypropylene box (2) described above, outwards at 25° C., is about 28.8 W hourly. If it is sought to maintain the temperature for 12 hours, the value dissipated outwards over 12 hours is 345.6 W.

The divider wall (5) has a receiving surface (7) made of two zones, each having an exchange surface area of about 499 $cm^2$. The divider wall (2) is made of expanded polypropylene and has a thickness of lcm, perforated with 60 orifices, each having a diameter of about 1 mm.

The divider wall has a thermal diffusion coefficient of 7.8 $W/m^2$. ° C. If the chamber receives two dry ice plates, each of 203×246×35 mm, that is 2 kg, emitting an energy of 1254 KJ, the heat value diffused by the divider wall (5) to the compartment is equal to 28.8 W hourly, and therefore equal to 345.6 W over 12 hours.

The heat value diffused by the divider wall (5) to the compartment is therefore equal to the heat value dissipated by the box for a duration of 12 hours after receiving two dry ice plates and exposure of the container (1) to a transport temperature of 25° C.

To maintain frozen products for 12 hours at 25° C., the thickness of the divider wall (5) made of expanded polypropylene could be less than lcm thick of polypropylene. Technically, such a thickness is not achievable by molding. This is the reason why the divider wall (5) has been perforated. Another solution would be to enlarge the exchange surface to let cold pass through.

Example 2

As an example, for the transport of fresh products at a conservation temperature of 2° C.

The box (2) is made of expanded polypropylene, delimiting a compartment having an inner surface area of 0.10 $m^2$. The walls of the box (2) have an average thickness of 35 mm.

The heat value dissipated by the example of a box (2) made of expanded polypropylene described above, outwards at 25° C., is about 14.7 W hourly. If it is sought to maintain the temperature for 12 hours, the value dissipated outwards over 12 hours is 176.4 W.

The divider wall (5) has a receiving surface (7) made of two zones, each having an exchange surface area of about 499 $cm^2$. The divider wall (5) is made of expanded polypropylene and has a thickness of 2 cm.

The divider wall has a thermal diffusion coefficient of 1.85 $W/m^2$. ° C. If the chamber receives one single dry ice plate of 203×246×25 mm, that is 0.72 kg, emitting a heat energy of 451.44 KJ, the heat value diffused by the divider wall (5) to the compartment is equal to 14.7 W hourly, and therefore equal to 176.4 W over 12 hours.

The heat value diffused by the divider wall (5) to the compartment is therefore equal to the heat value dissipated by the box for a duration of 12 hours after receiving dry ice plates and exposure of the container (1) to a transport temperature of 25° C.

To maintain fresh products for 12 hours at 25° C. externally, the divider wall (5) made of expanded polypropylene must have a thickness of 2 cm. If the divider wall (5) is made of polyurethane, its thickness must be 1 cm.

The cover (4) and the intermediate wall (5) comprise complementary locking/unlocking means (9) to be locked onto one another and thus secure access to the refrigerated load (6).

Figure 5:
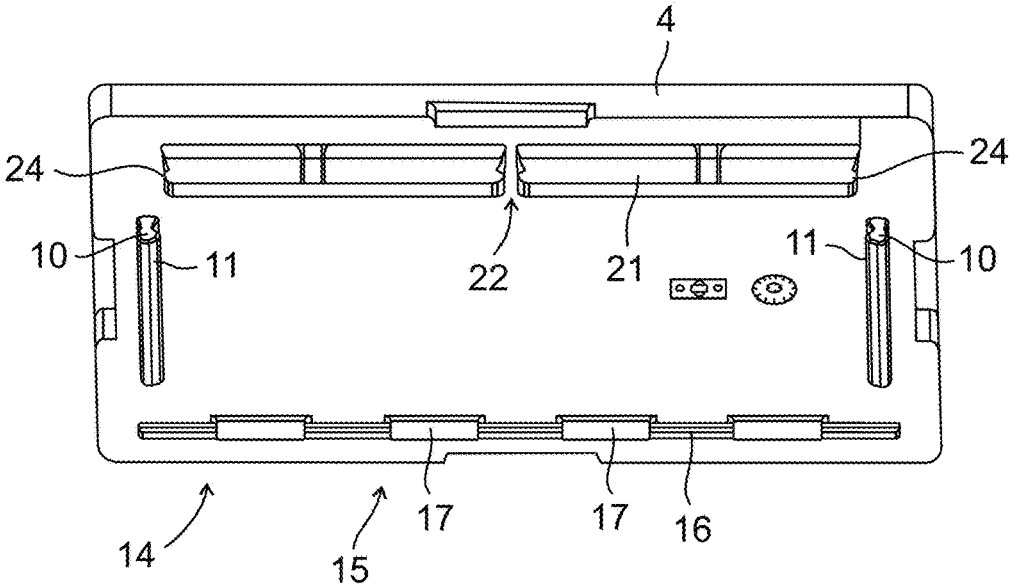
FIG. 5 is a front and perspective view of the cover.
Figure 6:
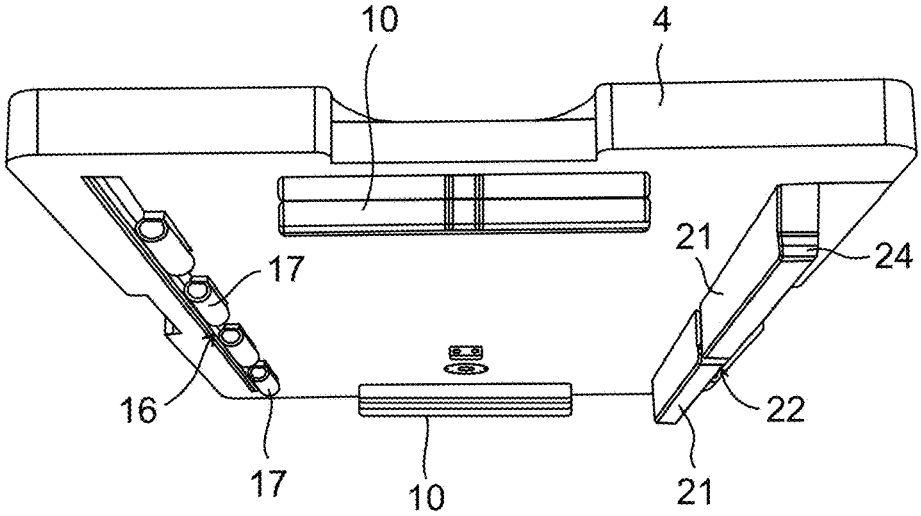
FIG. 6 is a side and perspective view of the cover.

For example, in reference to FIGS. 5 and 6, the means (9) for locking/unlocking the cover (4) comprise two side strips (10), each projecting orthogonally from a side edge of the cover (4) and in the direction of the divider wall (5). Each side strip (10) comprises at its free end, a lug (11) which projects towards the opposite strip (10).

Figure 7:
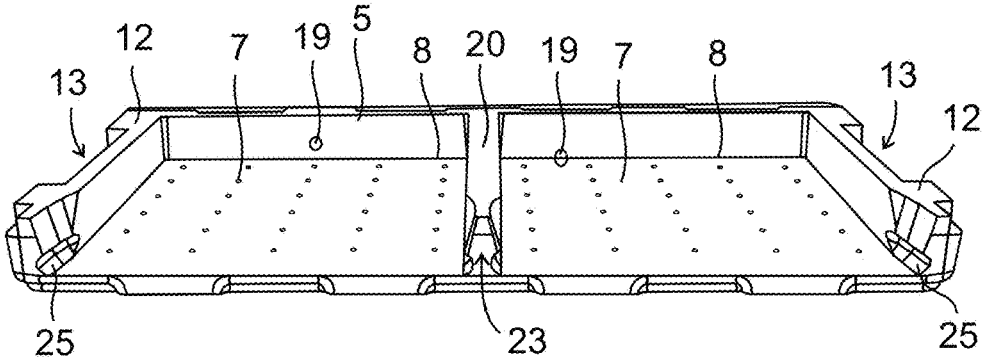
FIG. 7 is a front and perspective view of the divider wall.
Figure 8:
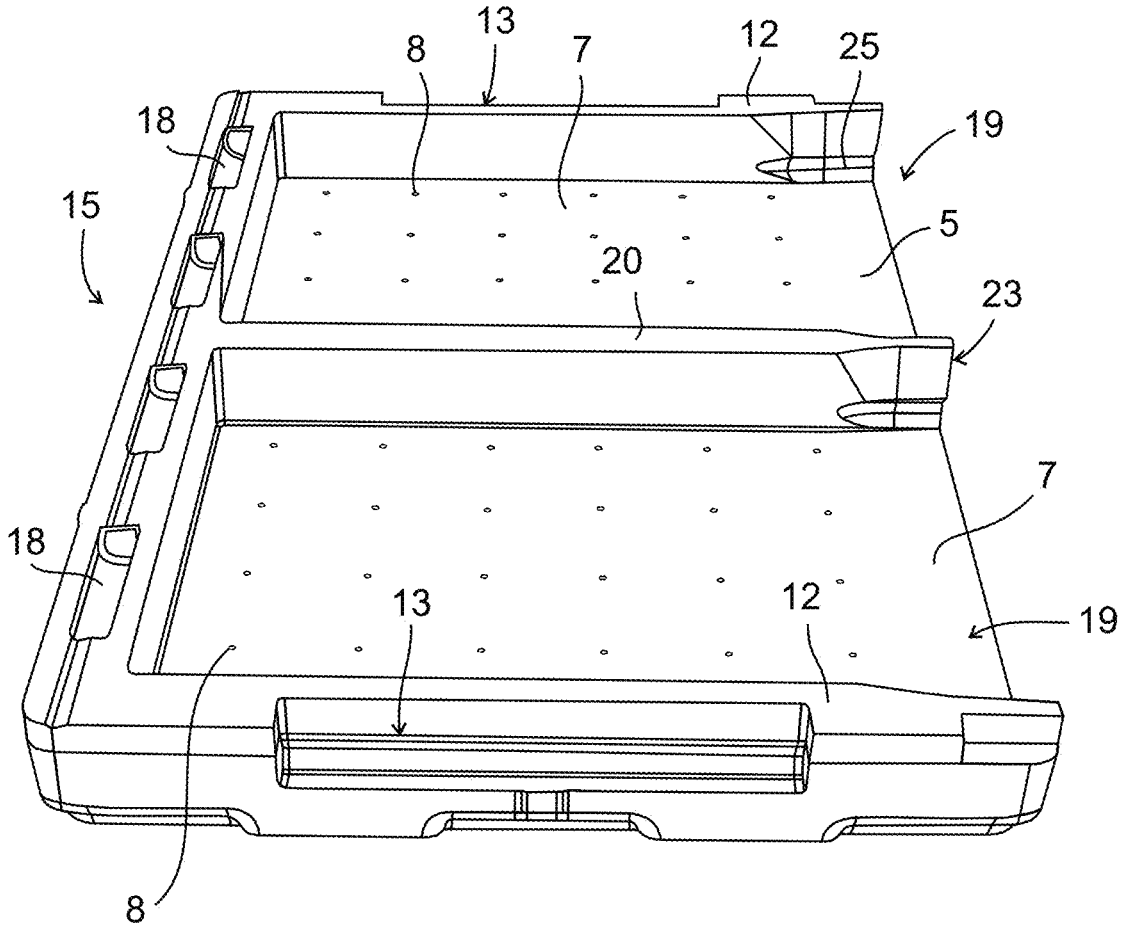
FIG. 8 is a side and perspective view of the divider wall.
Figure 9:
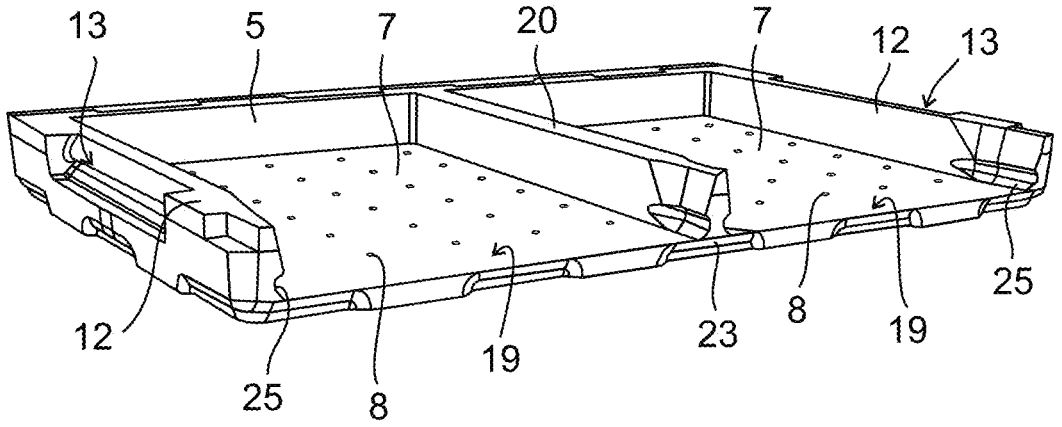
FIG. 9 is a three-quarter perspective view of the divider wall.

Furthermore, and in reference to FIGS. 7 to 9, the locking/unlocking means (9) of the intermediate wall (5) comprise side edges (12) projecting towards the cover (4), and wherein are arranged notches (13) complementary to the side strips (10) and to the lugs (11).

In particular, the cover (4) and the intermediate wall (5) are intended to be locked onto the other during a pivoting movement of the cover (4) with respect to the divider wall (5) along a pivoting edge (14), and after having received at least one refrigerated load (6).

The cover (4) and the intermediate wall (5) are independent from one another and comprise complementary articulation means (15), capable of allowing the cover (4) to pivot with respect to the divider wall (5), in order to allow the refrigerated load (6) to be loaded into the chamber.

In reference to FIGS. 5 to 10, the articulation means (15) of the cover (4) comprise at least one groove (16) disposed along the pivoting edge (14) and facing the divider wall (5). A projecting ridge (17) with a circular cross-section borders the inner side of the groove (16), i.e. the side opposite the pivoting edge (14). The longitudinal groove (16) as well as the projecting ridge (17) with a circular cross-section, can be continuous over practically the whole length of the cover (4), or constituted of discontinuous portions. The discontinuous character of the projecting ridge (17) allows to provide more security to the assembly. If one of the projecting portion (17) breaks, the cover (4) can still be used. Moreover, the discontinuous character also allows to balance the load over said ridges (17) and therefore avoid urging one single ridge (17) too much.

Furthermore, the articulation means (15) of the divider wall (5) comprise at least one groove (18) complementary to the projecting ridge (17), intended to receive an engagement of said projecting ridge (17), with pivoting capacity. As above, the complementary groove (18) of the divider wall (5) can be discontinuous.

Figure 10:
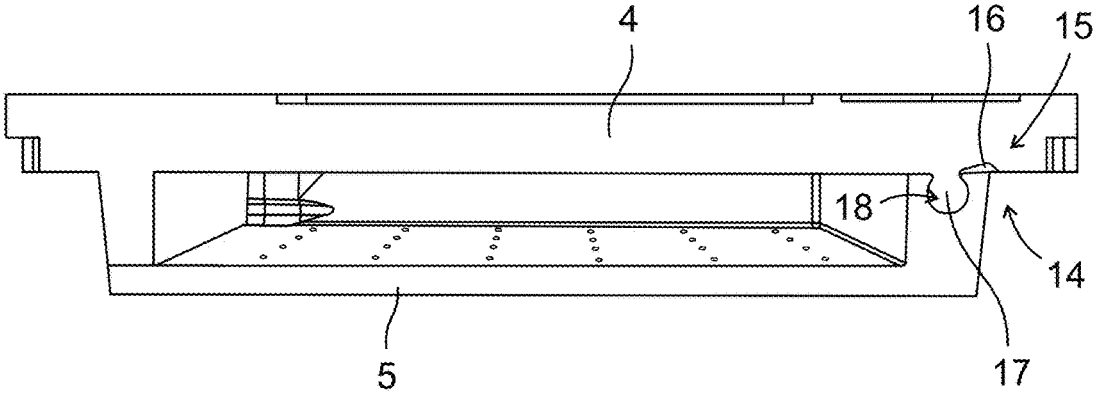
FIG. 10 is a transverse vertical cross-sectional view of the cover and of the divider wall locked onto one another.

Thus, in reference to FIG. 10, when the cover (4) is locked onto the intermediate wall (5), the projecting ridge (17) with a circular cross-section is inserted in the groove (18) of the divider wall (5).

This embodiment of complementary articulation means (15) allows to keep the independence between the cover (4) and the divider wall (5), by minimizing the thermal bridges.

Figure 11:
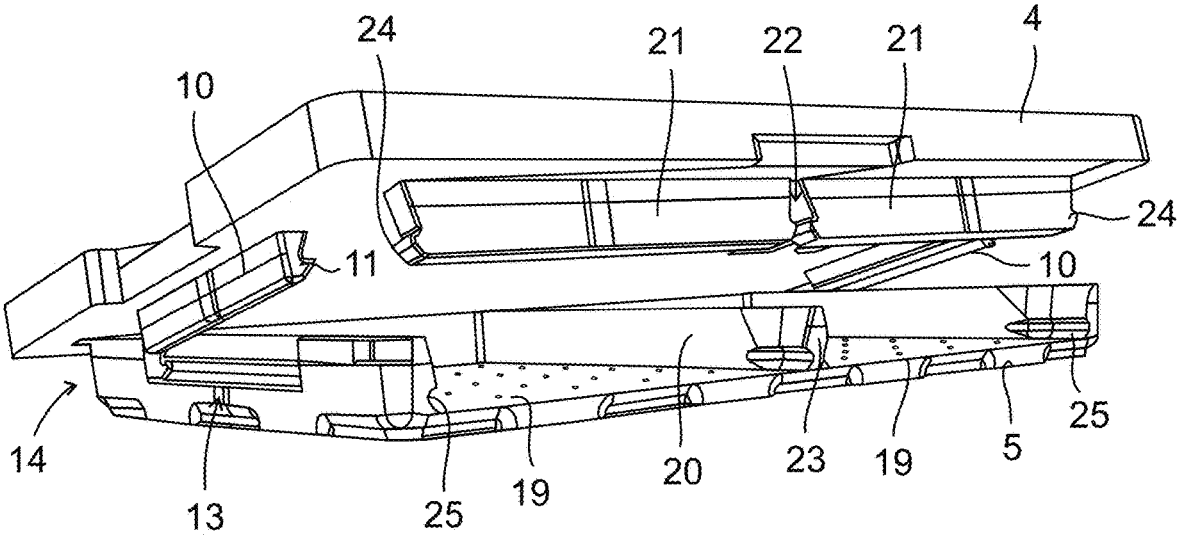
FIG. 11 is a perspective view of the cover placed on the divider wall and pivoted in the open position.

In reference to FIG. 11, the cover (4) can therefore pivot about an angle comprised between 10° and 60° with respect to the divider wall (5) in an opening position to access the chamber and allow the loading of at least one refrigerated load (6).

In order to be adapted to the desired application, the surface (7) for receiving the refrigerated load (6) can be split into two receiving zones (19) by a central strip (20) perpendicular to the pivoting edge (14).

In this embodiment, and in reference to FIGS. 5 and 6, the locking/unlocking means (9) of the cover (4) can comprise two front strips (21) projecting orthogonally from the edge of the cover (4) opposite the pivoting edge (14), and in the direction of the divider wall (5). The two front strips (21) are in particular positioned on either side of the central strip (20) and delimit between them a form of restraint (22), for example, arrow-shaped.

Complementarily, the end of the central strip (20) of the divider wall (5), facing the form of restraint (22) of the cover (4), comprises a complementary form of restraint (23) to be locked between the two front strips (21).

Advantageously, in reference to FIGS. 5, 7 and 9, the side ends of the front strips (21) are each provided with a projecting lug (24) intended to be snap-fitted in complementary notches (25) arranged in the edges (12) of the divider wall (5).

According to the invention, in order to load a refrigerated load (6) between the cover (4) and the divider wall (5), the cover (4) must be made to automatically pivot along its pivoting edge (14) by an angle comprised between 10° and 60°, from a divider wall (5) on which is placed the cover (4) with pivoting capacity with respect to the divider wall (5) and along a pivoting edge (14), and to automatically push at least one refrigerated load (6) inside the chamber.

To do this, the invention also relates to an installation (26) comprising divider wall (5) support means (27) on which is placed the cover (4) and means for pivoting (28) the cover (4), for example in the form of an actuator able to raise the front edge of the cover (4).

Figure 14:
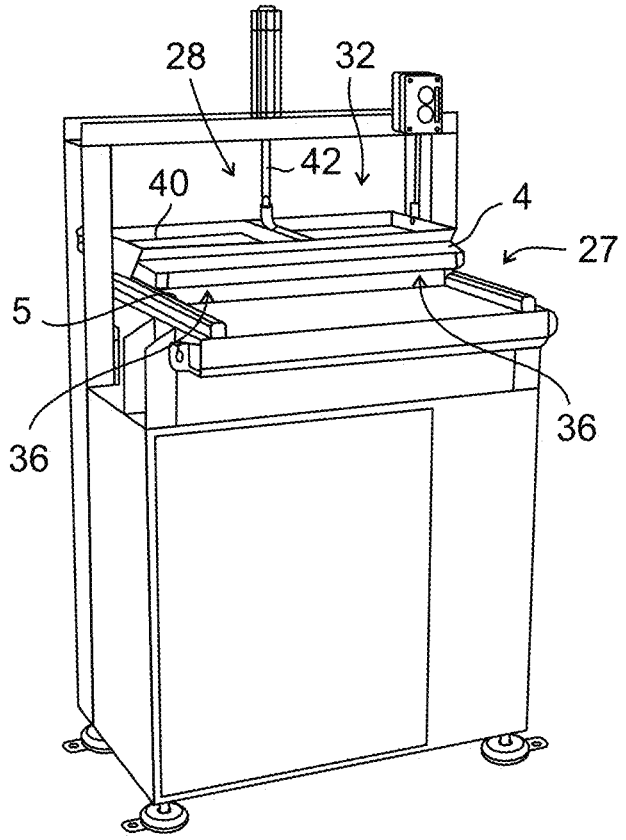
FIG. 14 is a perspective, front view of another embodiment of an installation for the implementation of the method.
Figure 15:
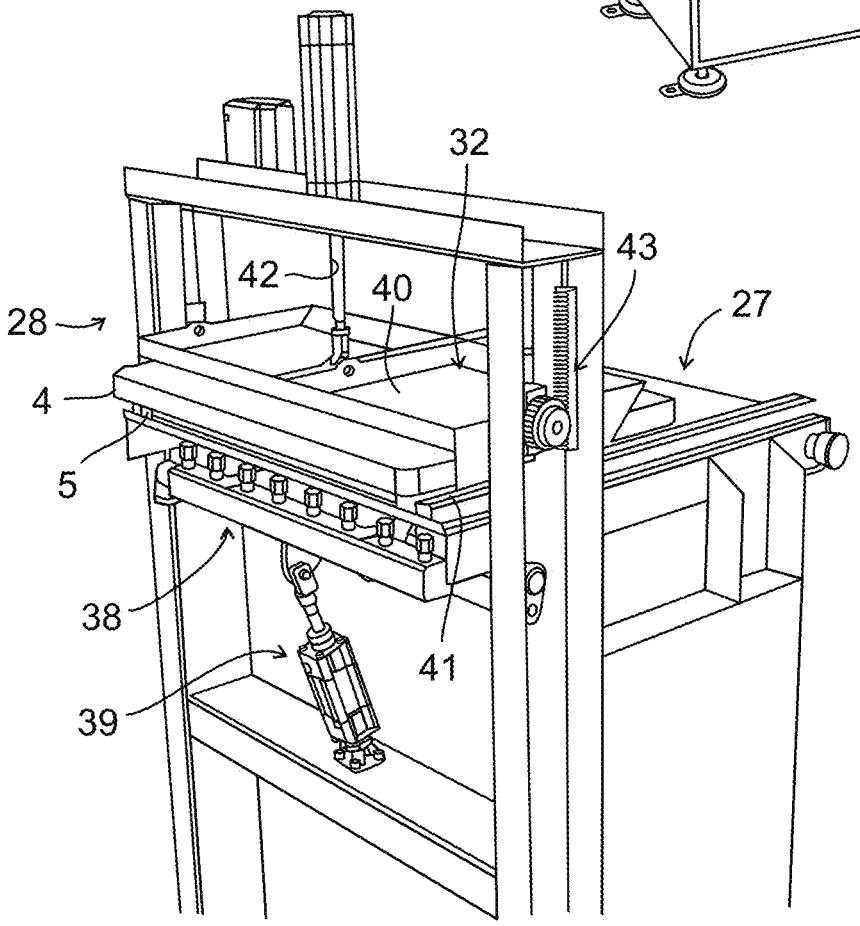
FIG. 15 is a rear perspective view of the installation of FIG. 14.
Figure 16:
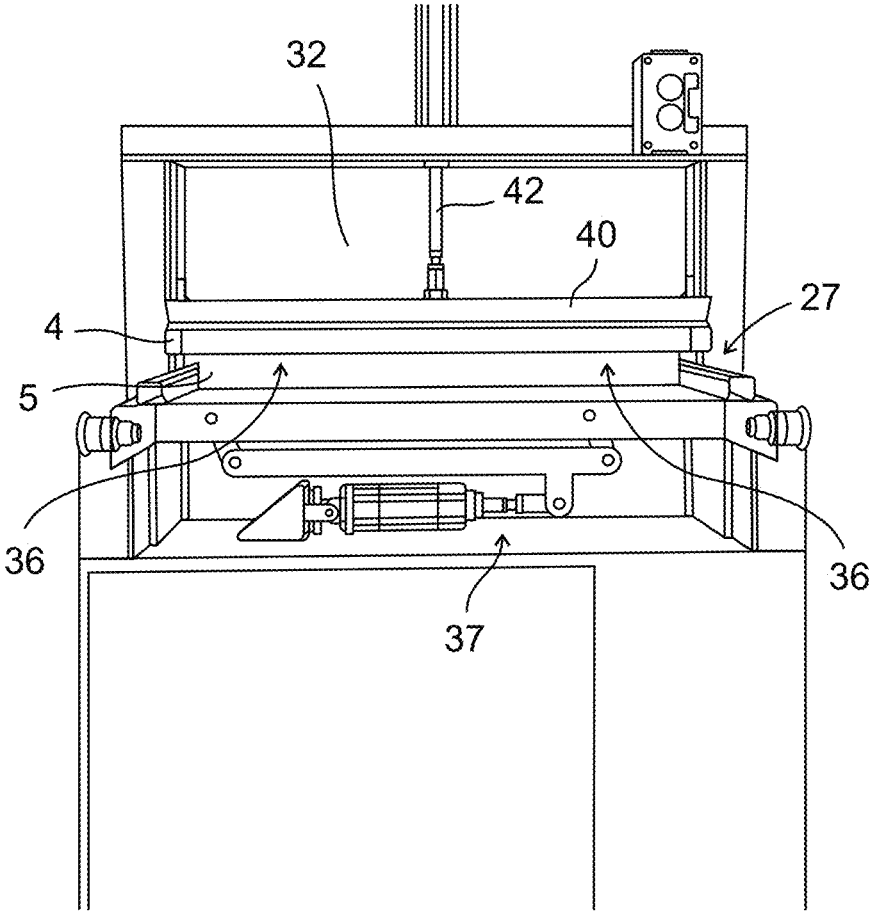
FIG. 16 is a front view of the installation, wherein a wall has been concealed to show a locking system in the position of the cover.

From this principle, several embodiments are possible. It is possible to implement an installation in the form of a linear installation, such as illustrated in FIG. 13, or for example an individual station, such as illustrated in FIGS. 14 to 16.

Figure 13:
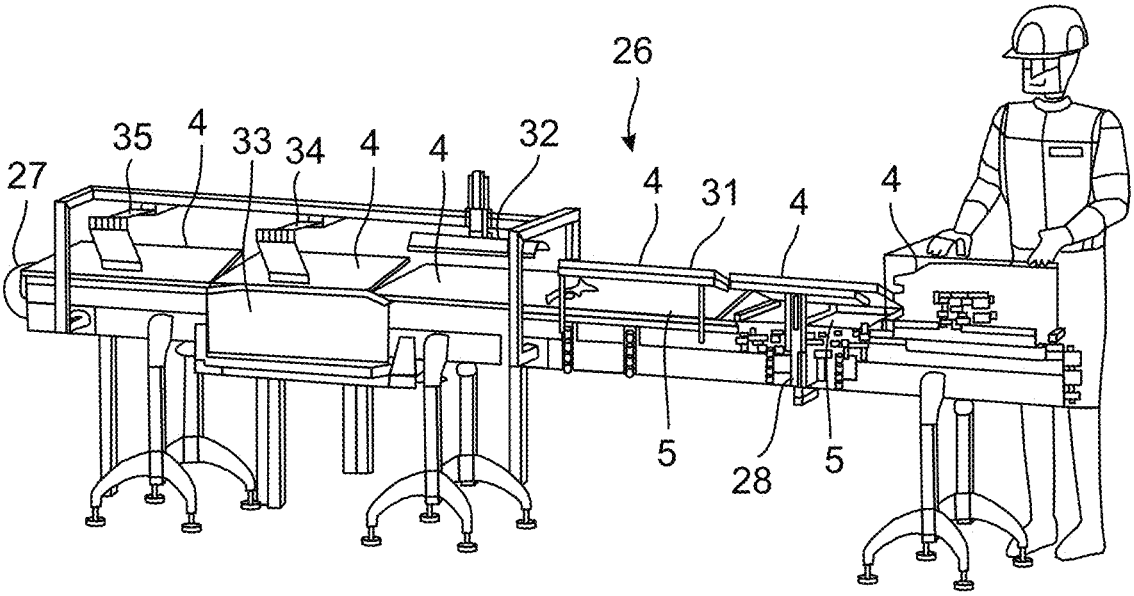
FIG. 13 is a perspective view of an installation for the implementation of a method for loading a refrigerated load in a container according to the invention.

In reference to FIG. 13, the support means (27) can be presented in the form of a conveyor cable to make the divider wall (5) scroll, on which is placed the cover (4). In this configuration, the pivoting means (28) of the cover (4) are positioned on the scrolling path of the cover (4).

Figure 12:
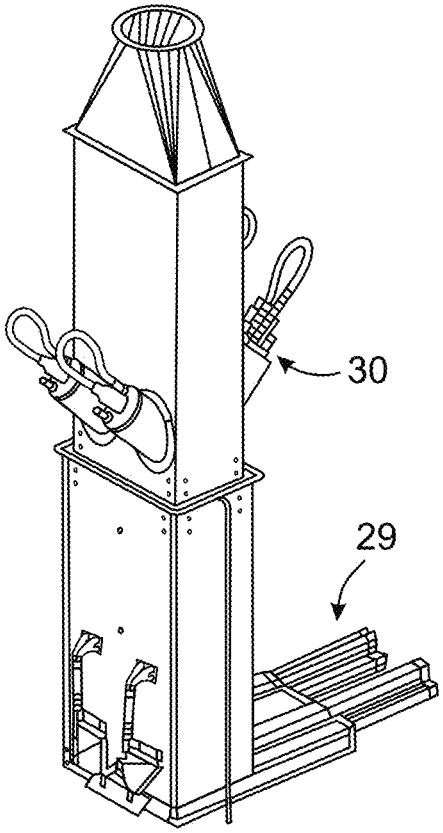
FIG. 12 is a perspective view of a means for generating a dry ice portion and means for pushing the portion inside the chamber.

In reference to FIG. 12, the installation (26) also comprises means for supplying (29) a refrigerated load (6). Preferably, the refrigerated load (6) is presented in the form of a block of dry snow or dry ice, and the supply means (29) are combined with means for generating (30) dry snow or dry ice. These generation means (30) allow to generate a block of dry snow or dry ice, which is then cut into portions, and the portions are pushed, for example by actuators, into the chamber between the cover (4) and the divider wall (5).

In reference to the installation (26) illustrated in FIG. 13, after having been raised by the actuator, the cover (4) is moved by way of the conveyor, still in the open position and bearing on a support bar (31) and maintained in the open position. The supply means (29) are not represented in FIG. 13, but they are, in practice, positioned facing the support bar (31).

The installation (26) then comprises means for automatically closing (32) the cover (4) on the divider wall (5) to lock them with one another after receiving the refrigerated load (6). These means (32) are presented, for example, in the form of an actuator able to bear on the top of the cover (4) to engage the different complementary locking/unlocking means (9).

The method advantageously comprises a step consisting of automatically controlling the refrigerated load (6) between the cover (4) and the divider wall (5) such that, in case of non-loading or partial unloading, the cover (4) and the divider wall (5) are sent to a reject or correction station (not represented) and, in case of total loading, the cover (4) and the divider wall (5) are sent to a closing station or a final station (not represented) in view of their positioning on a box (2).

Figure 3:
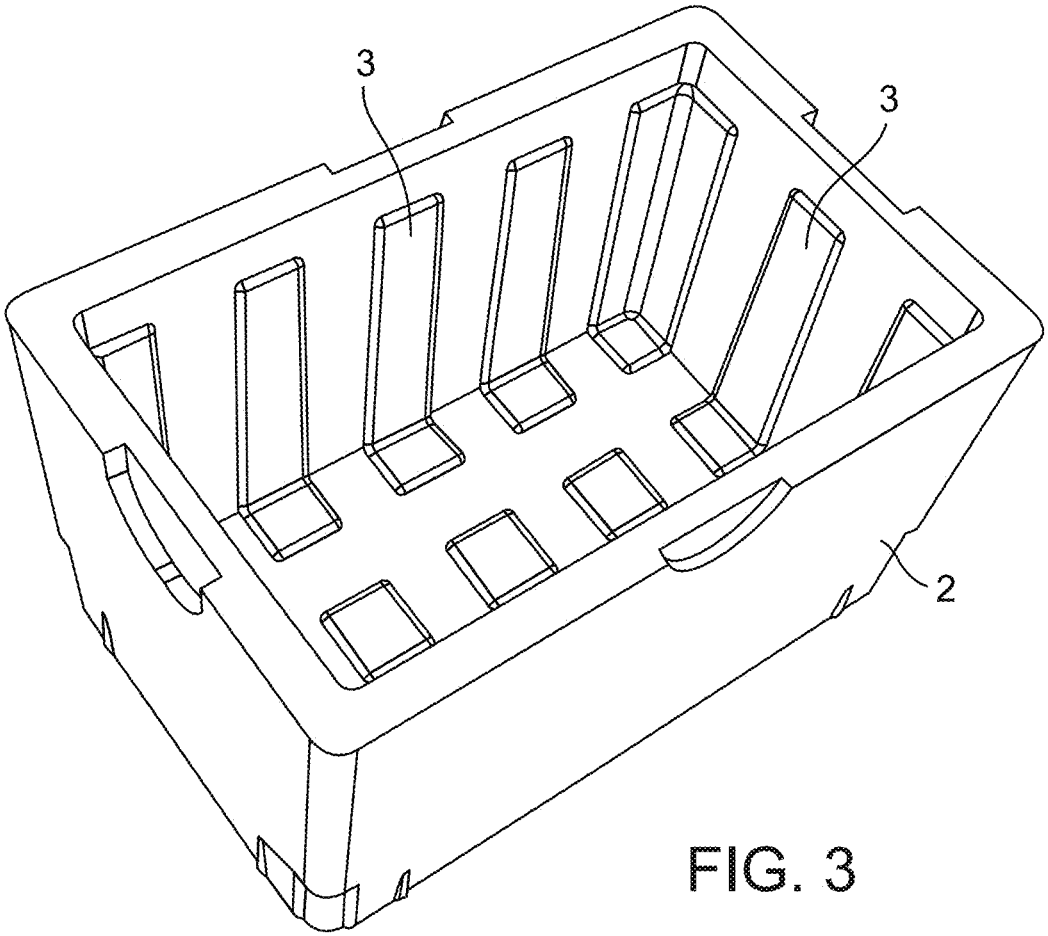
FIG. 3 is a perspective view of the box opened upwards.
Figure 4:
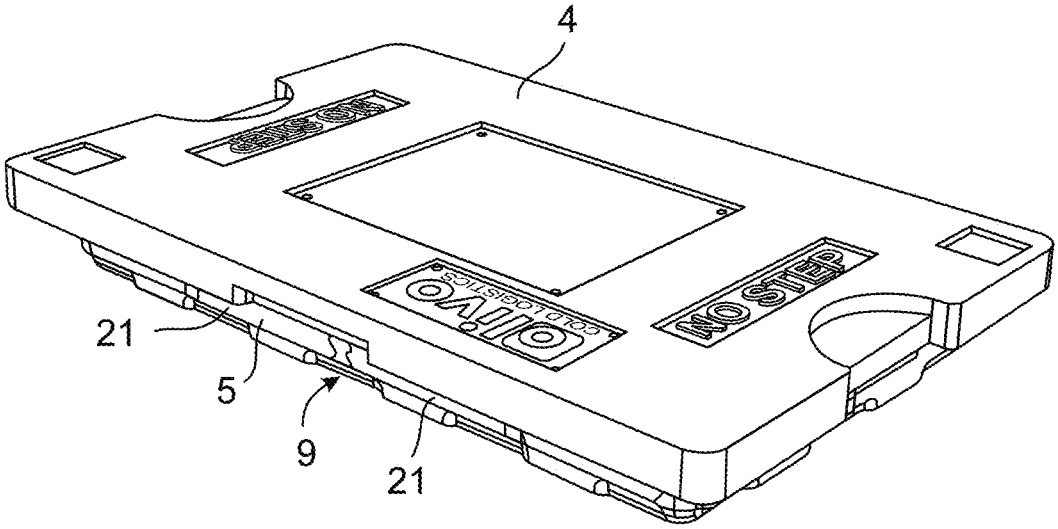
FIG. 4 is a perspective view of the cover and of the divider wall locked onto one another.

On the installation (26) illustrated in FIG. 3, the step consisting of controlling the loading of the refrigerated load (6) is done after the closing of the cover (4).

To do this, the installation (26) comprises, in a particular embodiment, a scale (33) positioned before or after the means for closing (32) the cover (4), to check the weight of the cover (4) and of the divider wall (5) loaded with a refrigerated load (6). If the weight does not match, an actuator (34) is able to laterally push the cover (4) and the divider wall (5) to the reject or correction station. If the weight is correct, the cover (4) and the divider wall (5) scroll towards another actuator (35) intended to laterally push the cover (4) and the divider wall (5) to a final station, in view of positioning said cover (4) and the divider wall (5) on a box (2) of a container (1) comprising products to have their temperature maintained.

In reference to FIGS. 14 to 16 illustrating the individual station, this comprises support means (27) in the form of a worksurface on which an operator positions the divider wall (5) and the cover (4). Curved cleats (36), actuated by an actuator system (37) project from the worksurface to lock the divider wall (5) and the cover (4) in abutment and in position, or are retracted to release the divider wall (5) and the cover (4). Flattening means (38), such as a suction pad system positioned under the worksurface and subservient to an actuator (39) flattening the divider wall (5) against the worksurface to allow the pivoting of the cover (4) without moving the divider wall (5).

When the divider wall (5) and the cover (4) are positioned on the support means (27), the cover is located positioned under a support plate (40) extended laterally by two edges (41) folded under the side edges of the cover (4). This support plate (40) is connected in an articulated manner to an actuator (42) such that the actuation of the actuator (42) allows to raise the support plate (40), removing by way of the folded edges (41), the pivoting of the cover (40). The articulation between the actuator (42) and the support plate (40) allows to make the cover (40) pivot.

Once the cover (4) is open, the supply means (29), not represented in FIGS. 14 to 16, push at least one snow plate into the chamber of the cover (4).

Then, the actuation of the actuator (42) in the opposite direction allows to bear, by way on the support plate (40) on the cover (4) to lock it onto the divider wall (5). The guiding of the support plate (40) is done laterally by a rack system (43).

Of course, the worksurface of the individual station can integrate a scale to control the weight of the refrigerated load (6).

The invention claimed is:

1. An installation for the implementation of a method for loading a refrigerated load into a product transport container with a desired temperature range, comprising:

a box made of insulating material delimiting a compartment opened upwards having a volume less than 150 liters and able to contain the products, the box having a determined heat dissipation value;

a cover made of insulating material adaptable on the box to seal the compartment;

a diffusing divider wall interposed between the box and the cover to delimit with the cover, a chamber with a surface for receiving at least one refrigerated load emitting a heat value, the cover and the divider wall comprising complementary means for locking/unlocking with one another;

wherein the heat energy emitted by the refrigerated load and the thermal diffusion coefficient of the divider wall are adjusted such that, at determined transport and conservation temperatures and for a desired duration after receiving the refrigerated load and exposure of the product transport container to the transport temperature, the heat value diffused by the divider wall to the compartment is equal to, or at most 20% greater than the heat value dissipated by the box, wherein, from a divider wall on which is placed the cover with pivoting capacity with respect to the divider wall and along a pivoting edge, the method comprises steps consisting of:

making the cover automatically pivot with respect to the divider wall to free up an access to the chamber for receiving the refrigerated load;

automatically pushing at least one refrigerated load inside the chamber wherein the chamber comprises:

means for supporting a divider wall on which is placed a cover;

means for automatically pivoting the cover;

means for supplying a refrigerated load and for pushing the refrigerated load inside the chamber.

2. The installation according to claim 1, wherein the installation comprises means for automatically closing the cover on the divider wall for their locking onto one another after receiving the refrigerated load.

3. The installation according to claim 1, wherein the installation comprises means for controlling the loading of the refrigerated load.

4. The installation according to claim 1, wherein the means for automatically pivoting the cover are presented in the form of an actuator able to raise a front edge or side edges of the cover.

5. The installation according to claim 1, wherein the refrigerated load is a block of dry snow or dry ice.

* * * * *